US007825047B2

(12) United States Patent
Nakanishi

(10) Patent No.: US 7,825,047 B2
(45) Date of Patent: Nov. 2, 2010

(54) SPREAD MAT

(75) Inventor: Shutaro Nakanishi, Komaki (JP)

(73) Assignee: Towa Co., Ltd., Aichi-Ken (JP)

( * ) Notice: Subject to any disclaimer, the term of this patent is extended or adjusted under 35 U.S.C. 154(b) by 63 days.

(21) Appl. No.: 10/580,796

(22) PCT Filed: May 20, 2004

(86) PCT No.: PCT/JP2004/006838

§ 371 (c)(1),
(2), (4) Date: Mar. 16, 2007

(87) PCT Pub. No.: WO2005/065499

PCT Pub. Date: Jul. 21, 2005

(65) Prior Publication Data

US 2007/0271720 A1 Nov. 29, 2007

(30) Foreign Application Priority Data

Jan. 7, 2004 (JP) ..... 2004-002410

(51) Int. Cl.

| | |
|---|---|
| ***A47L 23/22*** | (2006.01) |
| ***A47L 23/24*** | (2006.01) |
| ***A47L 23/26*** | (2006.01) |
| ***A47G 27/00*** | (2006.01) |
| ***A47G 27/02*** | (2006.01) |
| ***B32B 27/14*** | (2006.01) |

(52) U.S. Cl. ..... 442/101; 442/74; 442/75; 442/417; 428/327; 15/215; 15/216; 15/217

(58) Field of Classification Search ..... None
See application file for complete search history.

(56) References Cited

U.S. PATENT DOCUMENTS 3,278,967 A * 10/1966 Hagerman ..... 15/215
4,501,783 A * 2/1985 Hiragami et al. ..... 428/147
4,510,201 A * 4/1985 Takeuchi et al. ..... 428/385

(Continued)

FOREIGN PATENT DOCUMENTS

DE 40 11 302 A1 10/1991

(Continued)

OTHER PUBLICATIONS

Kirk, Don. "A Quick and Easy Formula for Mesh-Mircon Particle Size Conversion" , Date Unknown, CSC Publishing, Powder and Bulk Engineering. <http://www.powderbulk.com/Content/viewRequest.aspx?ID=ba022613-4793-4e71-b510-f92867906637&fi=1>.*

(Continued)

*Primary Examiner*—Jennifer A Chriss
(74) *Attorney, Agent, or Firm*—Ohlandt, Greeley, Ruggiero & Perle, L.L.P.

(57) ABSTRACT

A spread mat capable of reducing, by suppressing slippage, the risk of getting injured by falling even if a surface layer is wet with oil or water. A crushed particulate material of 15 to 80 meshes is sprayed and adhered onto the front surface of the spread mat formed by stacking a large number of synthetic resin filaments in loop shape through an adhesive agent at a distribution rate of 50 to 150 g/m$^2$.

5 Claims, 3 Drawing Sheets

U.S. PATENT DOCUMENTS

| | | | | |
|---|---|---|---|---|
| 5,879,776 | A | 3/1999 | Nakata | |
| 2002/0111406 | A1* | 8/2002 | Kwak et al. | 524/310 |

FOREIGN PATENT DOCUMENTS

| | | | |
|---|---|---|---|
| GB | 1 247 373 | A | 9/1971 |
| JP | 62-203291 | U | 12/1987 |
| JP | 63-189064 | U | 12/1988 |
| JP | 5-311561 | A | 11/1993 |
| WO | WO 2005/065499 | A1 | 7/2005 |

OTHER PUBLICATIONS

Supplementary European Search Report for PCT/JP2004/006838, dated Jan. 9, 2007.

Japanese Search Report based on PCT/JP2004/006838 dated Aug. 17, 2004.

* cited by examiner

SPREAD MAT

FIELD OF THE INVENTION

The present invention relates to a spread mat formed by stacking a large number of synthetic resin filaments in loop.

DISCUSSION OF THE BACKGROUND ART

In the conventional technique, this type of a spread mat is formed by extruding a molten soft vinyl chloride resin through a die, and then spinning the molten soft vinyl chloride resin into a large number of filaments which are then stacked in loop (see JP-A 5-311561 (page 5, FIGS. 7 and 8)). The spread mat thus formed is spread over the installation site of metal working machines in the working site in plants, gas stations, etc. The spread mat thus formed is also spread over predetermined sites at the entrance of buildings as shoe scraper.

However, the aforementioned spread mat to be spread over the installation site of working machines often has lubricant or cutting oil scattered on the front surface thereof. When wet with lubricant or cutting oil thus scattered, the surface layer of the spread mat is rendered slippery. Also at gas stations, when wet with petroleum or kerosene, the spread mat is then rendered slippery on the front surface thereof. Further, when it rains or snows, the spread mat over the entrance of buildings is wet on the front surface thereof and is thus rendered slippery. Therefore, when men walk on these slippery spread mats, they accidentally slip and fall to get injured.

The present invention has thus been worked out to solve the aforementioned problem. It is therefore an object of the present invention to provide a spread mat capable of reducing, by suppressing slippage, the risk of getting injured by falling even if a surface layer is wet with oil or water.

SUMMARY OF THE INVENTION

A spread mat that is obtained by spraying and bonding crushed particulate material of from 15 to 80 meshes at a distribution rate of from 50 to 150 g/m$^2$ through an adhesive agent onto the front surface of a spread mat formed by stacking a large number of synthetic resin filaments in loop.

The aforementioned crushed particulate material is formed by crushing a hard synthetic resin material.

In accordance with the present invention, crushed particulate material of from 15 to 80 meshes is sprayed and bonded at a distribution rate of from 50 to 150 g/m$^2$ through an adhesive agent onto the front surface of a spread mat formed by stacking a large number of synthetic resin filaments in loop. In this manner, the front surface of the spread mat can be roughened to enhance the coefficient of slip resistance thereof, making it possible to give non-slip properties that can reduce the risk of getting injured by falling.

The crushed particulate material can be obtained by crushing a hard synthetic resin material. The crushed particulate material has a reduced weight and can be easily bonded with an adhesive agent, thereby being difficult to peel off the surface of the filaments.

DETAILED DESCRIPTION OF THE PREFERRED EMBODIMENT

The spread mat according to the present invention will be further described hereinafter in the attached drawings. The spread mat according to the present invention is spread over the installation site of metal working machines in the working site in plants, gas stations, etc. The spread mat is also spread over predetermined sites at the entrance of buildings as shoe scraper.

Figure 1:
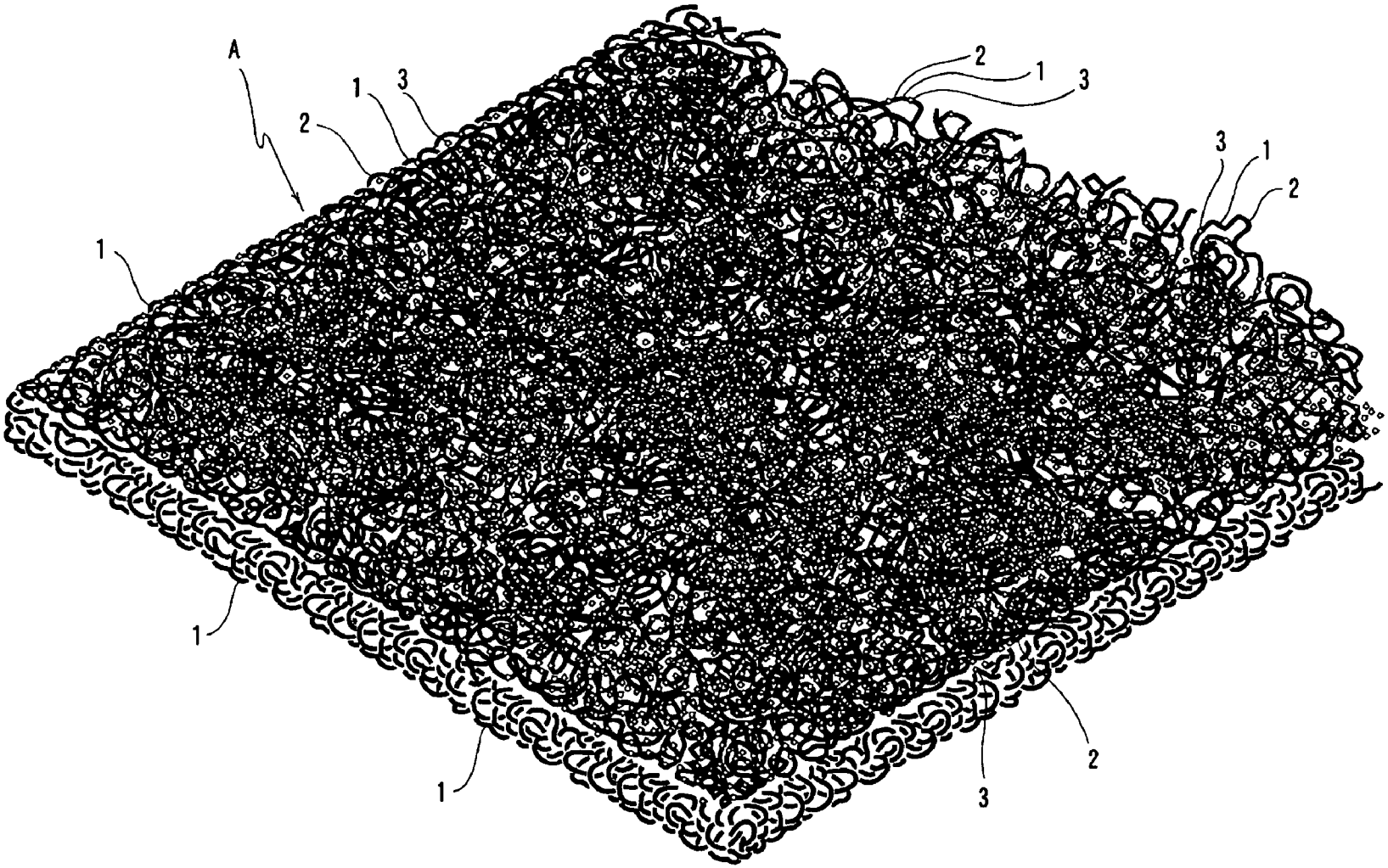
FIG. 1 is a partial perspective view of a spread mat according to the present invention.
Figure 2:
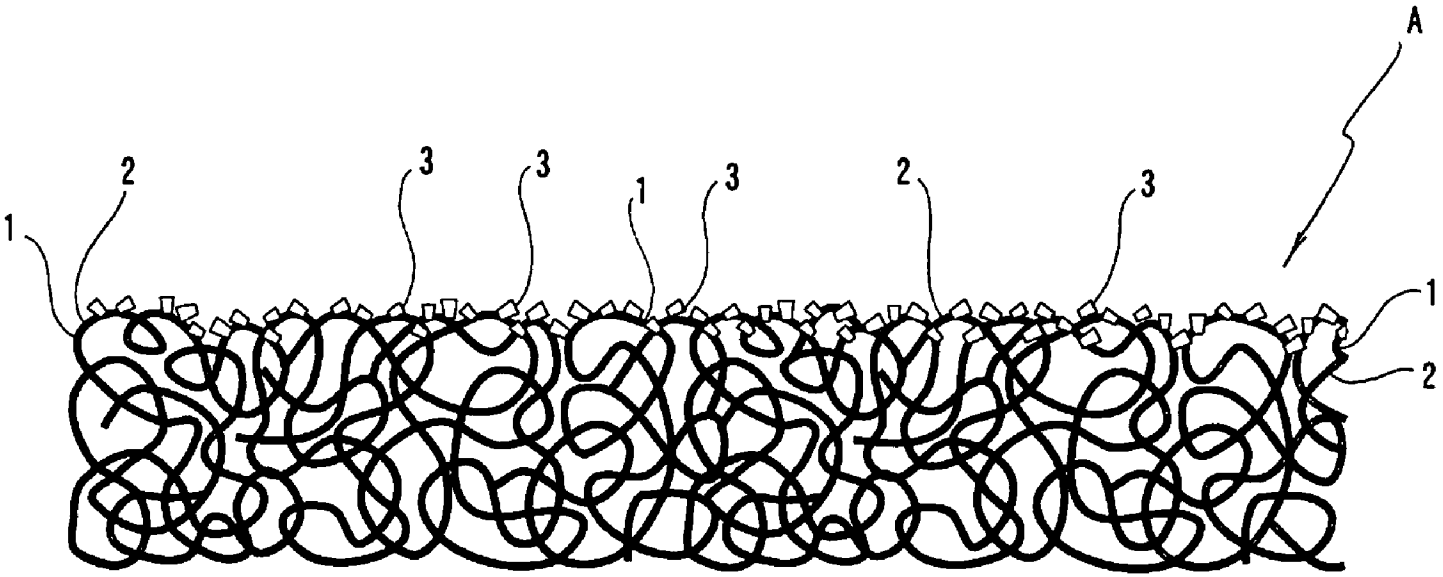
FIG. 2 is an enlarged partial sectional view of the spread mat.

FIG. 1 is a partial perspective view of a spread mat according to the present invention. FIG. 2 is an enlarged partial sectional view of the spread mat. This spread mat is formed by spinning a molten soft vinyl chloride resin into a large number of filaments which are then stacked in loop. The mat A shown is of a small diameter type comprising filaments 1 having a diameter of 0.4 mm. Besides this type, there are a middle diameter type comprising filaments having a diameter of 0.8 mm and a large diameter type comprising filaments having a diameter of 1.2 mm. Referring to the thickness of the three types of spread mats, the thickness of the mat A, which is of a small diameter type, the middle diameter type of spread mat and the large diameter type of spread mat are predetermined to 11 mm, 12 mm and 16 mm, respectively.

A crushed particulate material 3 which is a slip preventive agent is sprayed onto the front surface of a spread mat of any of the aforementioned three types with an adhesive agent 2. The adhesive agent 2 is prepared by mixing, e.g., a polyester-based plasticizer such as polyvinyl chloride-based paste resin and adipic acid-based polyester, a stabilizer and a paste resin diluent. Referring to the mixing proportion of these components, the mixing proportion of the polyester-based plasticizer such as adipic acid-based polyester, the stabilizer and the paste resin diluent are from 60 to 80 parts by weight, from 2 to 3 parts by weight and from 10 to 20 parts by weight, respectively, based on 100 parts by weight of the polyvinyl chloride-based paste resin. The crushed particulate material 3 is prepared by adding a plasticizer in an amount of 30 parts by weight at most, based on 100 parts by weight of a hard vinyl chloride resin, mixing the mixture with a stabilizer, a colorant and a filler in proper amounts, hot-kneading the mixture, molding the mixture into a desired shape such as column and cube, and then finely crushing/cutting the molded product. In this case, the use of recyclable materials allows not only effective utilization but also reduction of production cost.

The grain size of the crushed particulate material 3 differs with the aforementioned three types of spread mats. For the small diameter type spread mat A, a crushed particulate material 3 of from 40 to 80 meshes is used. For the middle diameter type of spread mat, a crushed particulate material of from 25 to 60 meshes is used. For the large diameter type of spread mat, a crushed particulate material of from 15 to 35 meshes is used. The definition of the grain size of the crushed particulate material 3 for the small diameter type of spread mat A to a range of from 40 to 80 meshes means that the crushed particulate material 3 can pass through a 40-mesh sieve but cannot pass through a 80-mesh sieve. This can apply also to the crushed particulate material for the other types of spread mats.

The distribution rate of the aforementioned crushed particulate material over the spread mat is predetermined to a range of from 50 to 150 g, particularly preferably 100 g per m$^2$. If the rate of the crushed particulate material falls below 50 g per m$^2$, sufficient slip preventive properties cannot be obtained. On the contrary, if the rate of the crushed particulate material exceeds 150 g per $m^2$, the crushed particulate material is much wasted.

Subsequently, the raw fabric of the spread mat is sprayed with an adhesive agent. The crushed particulate material is then sprayed onto the front surface of the raw fabric of the spread mat in a predetermined rate to form the spread mat. The spread mat thus formed has a roughened surface and thus exhibits an enhanced coefficient of slip resistance and hence desired slip preventive properties.

Figure 3:
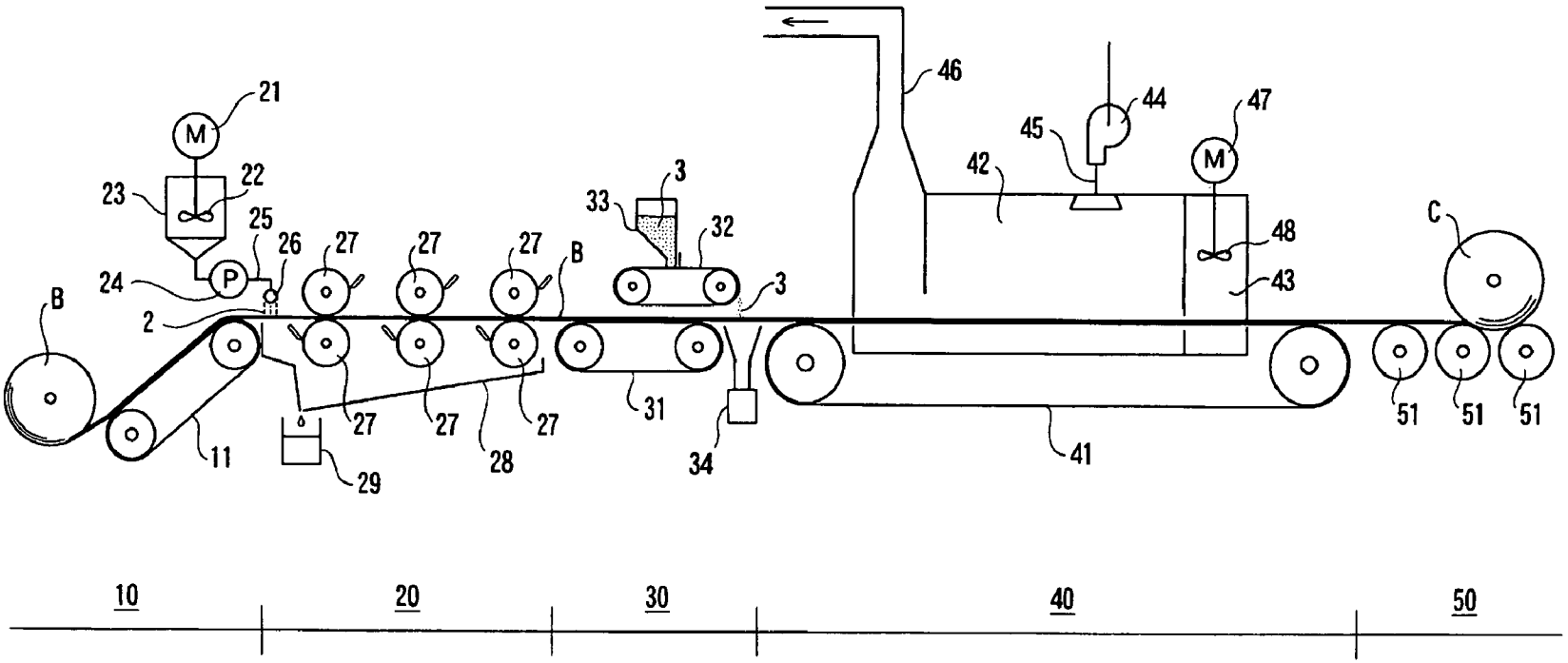
FIG. 3 is a schematic diagram illustrating a process for the production of the spread mat.

A process for the production of the aforementioned spread mat will be described hereinafter. FIG. 3 is a schematic diagram illustrating a production process comprising a mat supplying zone 10, a pasting zone 20, a crushed particulate material spraying zone 30, a heating zone 40 and a mat winding zone 50 disposed sequentially in juxtaposition.

At the mat supplying zone 10, a feed conveyor 11 is disposed tilted with the forward end thereof positioned higher than the rear end thereof. The raw fabric B of spread mat wound in many turns is disposed in the vicinity of the base end of the feed conveyor 11. At the pasting zone 20, a paste tank 23 in which a molten adhesive agent 2 is reserved with stirring by a screw 22 rotated by a motor 21 is disposed above the feed conveyor 11. A pump 24 is provided integrally with the paste tank 23. To the pump 24 is connected a discharge pipe 25 through which the adhesive agent 2 is sequentially extruded to the discharge side. At the forward end of the discharge pipe 25 is provided a paste ejection nozzle 26 through which the adhesive agent 2 is ejected downward. On one side of the feed conveyor 11, three sets of a pair of upper and lower paste squeeze rollers 27, 27 are disposed in line. Under these squeeze rollers 27, 27, a paste collecting pan 28 for collecting the adhesive agent 2 is disposed. The paste collecting pan 28 is tilted with one end thereof positioned lower than the other. Under the opening of the lower end of the paste collecting pan 28, a paste receiving tank 29 for reserving the extra adhesive agent 2 is disposed.

At the crushed particulate material spraying zone 30, a horizontal feed conveyor 31 is disposed. Above the horizontal feed conveyor 31, a spraying conveyor 32 for spraying the crushed particulate material 3 is disposed horizontally. Above the spraying conveyor 32 is disposed a damper 33 for supplying the crushed particulate material 3 onto the spraying conveyor 32 in a predetermined amount at a predetermined rate. Under the crushed particulate material dropping side of the spraying conveyor 32 is disposed a particulate material receiving tank 34 for recovering the extra crushed particulate material 3 left unattached to the spread mat.

At the heating zone 40, a heating conveyor 41 is disposed horizontally. Above the heating conveyor 41, a heating chamber 42 and a cooling chamber 43 are disposed in such an arrangement that the upper and lower surfaces of the conveying portion of the heating conveyor 41 are covered. To the heating chamber 42 is connected a hot air pipe 45 through which a hot gas from a gas burner is supplied thereinto. The heating chamber 42 has a discharge pipe 46 provided at the base end thereof through which the waste gas is discharged to the exterior. The cooling chamber 43 has a blower 48 provided therein which rotates when driven by a motor 47. At the mat winding zone 50, three winding rollers 51 are disposed in juxtaposition.

The raw fabric B of spread mat which has been introduced from the mat supplying zone 10 over the upper surface of the feed conveyor 11 is sprayed with the molten adhesive agent 2 ejected from the paste ejection nozzle 26 on the front surface thereof at the pasting zone 20. The extra adhesive agent 2 is then removed by the pair of paste squeeze rollers 27, 27. The raw fabric B which has thus been coated with the adhesive agent 2 in a proper quantity on the front surface thereof is passed to the crushed particulate material spraying zone 30 at which a predetermined amount of crushed particulate material 3 is then sprayed onto the front surface thereof. The extra crushed particulate material 3 which has been left unattached to the front surface of the raw fabric B and dropped is then recovered by the particulate material receiving tank 34 disposed thereunder. The amount of the crushed particulate material 3 to be sprayed can be adjusted by changing the rotary speed of the spraying conveyor 32.

Subsequently, the raw fabric B is passed to the heating zone 40 and then heated in the heating chamber 42. In this manner, the molten adhesive agent 2 is gelatinized and solidified so that the crushed particulate material 3 can be firmly fixed to the surface of the filaments 1 of the spread mat which is raw fabric B. The raw fabric B which has thus been heated is then cooled in the cooling chamber 43. The raw fabric B which has been discharged is trimmed at the both edges thereof, and then wound as product C on the winding roller 51 in the mat winding zone 50. The product C is then cut into a predetermined length before use.

Since the spread mat thus prepared has a proper amount of crushed particulate material 3 firmly bonded to the surface of the filaments 1 on the front surface thereof as shown in FIG. 2, the crushed particulate material 3 acts as a slip preventive to roughen the front surface of the spread mat. Accordingly, the spread mat becomes less slippery even when wet with oil or water on the front surface thereof, making it less likely that men can accidentally slip and fall to get injured.

Results of experiments for examining the slip preventive effect will be given below. As samples there were used the aforementioned three types of spread mats. These samples were each measured for coefficient of slip resistance when dried and when wet with lubricant. The results were compared.

| | Coefficient of slip resistance | |
|---|---|---|
| Sample | Dry | Wet (with lubricant) |
| Large diameter type | 0.46 | 0.39 |
| Middle diameter type | 0.40 | 0.36 |
| Small diameter type | 0.43 | 0.38 |

As can be seen in these results, the large diameter type of spread mat exhibits a slip resistance coefficient of 0.46 and 0.39, respectively, when dried and when wet. The ratio of coefficient of slip resistance when wet to when dried is 0.84 (=0.39/0.46), demonstrating that the coefficient of slip resistance shows a drop of about 10% even when wet with lubricant. For reference, the middle diameter type of spread mat shows a slip resistance coefficient ratio of 0.90. The small diameter type of spread mat shows a slip resistance coefficient ratio of 0.88.

In the present invention, a hard vinyl chloride resin is used as crushed particulate material because it can be fairly bonded to the spread mat with the adhesive agent of the present invention. When other proper adhesives are selected, other materials, e.g., sand or particulate ceramic having a predetermined grain size may be used as crushed particulate material.

What is claimed is:

1. A spread mat, comprising:

a porous mat body containing stacked and looped resin filaments, said porous mat body having a front surface, and said resin filaments having front portions in said front surface;

an adhesive agent spray-formed on said front surface of the porous mat body such that the adhesive agent is attached directly to said front portions of the filaments; and crushed particulate material attached to the front surface of the porous mat body through the adhesive agent, wherein the crushed particulate material includes particles attached to the front portions of the filaments through the adhesive agent;

wherein the particles are of from 15 to 80 meshes and are distributed on the front surface of the porous mat body in a range of from 50 to 150 g/m$^2$, and wherein the adhesive agent is a mixture of a polyvinyl chloride-based paste resin, a polyester-based plasticizer, a stabilizer and a diluent.

2. The spread mat as defined in claim 1, wherein the crushed particulate material is formed by a hard synthetic resin material.

3. The spread mat of claim 1, wherein said adhesive agent is spray-formed on said front surface of the spread mat only.

4. The spread mat of claim 1, wherein said adhesive agent comprises 60-80 parts by weight of said polyester-based plasticizer, 2-3 parts by weight of said stabilizer, and 10-20 parts by weight of said diluent based on 100 parts by weight of the polyvinyl-based paste resin .

5. The spread mat of claim 2, wherein said crushed particulate material comprises a plasticizer in an amount of up to 30 parts by weight based on 100 parts by weight of the hard synthetic resin material.

* * * * *